US011056087B2

(12) United States Patent
Anderson

(10) Patent No.: US 11,056,087 B2
(45) Date of Patent: Jul. 6, 2021

(54) DOOR STRINGED INSTRUMENT MOUNT

(71) Applicant: Stephanie Anderson, Yountville, CA (US)

(72) Inventor: Stephanie Anderson, Yountville, CA (US)

( * ) Notice: Subject to any disclaimer, the term of this patent is extended or adjusted under 35 U.S.C. 154(b) by 0 days.

(21) Appl. No.: 15/051,676

(22) Filed: Feb. 24, 2016

(65) Prior Publication Data

US 2017/0263224 A1 Sep. 14, 2017

(51) Int. Cl.
*G10G 5/00* (2006.01)
*E06B 7/28* (2006.01)

(52) U.S. Cl.
CPC *G10G 5/00* (2013.01); *E06B 7/28* (2013.01)

(58) Field of Classification Search
CPC ..... G10G 5/00; E06B 7/28; F16M 13/022
USPC ..... 248/215, 301, 327, 339
See application file for complete search history.

(56) References Cited

U.S. PATENT DOCUMENTS 1,532,688 A * 4/1925 Feuerstein ..... H04M 1/11 248/229.12
3,765,633 A * 10/1973 Caudill ..... G10G 5/00 24/457
4,078,753 A * 3/1978 Cole ..... A47F 5/0006 211/85.6
4,991,809 A * 2/1991 Harkey ..... G10G 5/00 248/229.12
5,313,866 A * 5/1994 Smith ..... G10G 5/00 248/121
5,372,346 A * 12/1994 Upchurch ..... F16B 21/04 248/222.52
5,645,256 A * 7/1997 Thomas, II ..... G10G 5/00 248/222.11
5,738,319 A * 4/1998 Grassi ..... A47G 7/044 248/215
6,091,008 A * 7/2000 Yu ..... G10G 5/00 248/220.41
6,231,018 B1 * 5/2001 Barbieri ..... G10G 5/00 248/302
6,302,365 B1 * 10/2001 Catanzarite ..... A47G 25/0614 248/215
6,311,851 B1 * 11/2001 Knudsen, Sr. ..... A01G 5/04 211/13.1
7,300,027 B2 * 11/2007 Walker ..... G10G 5/00 248/121
7,464,910 B1 * 12/2008 St. Germain ..... G10G 5/00 211/85.6
7,484,701 B2 * 2/2009 Hsieh ..... A47F 5/0853 211/106.01

(Continued)

*Primary Examiner* — Terrell L McKinnon
*Assistant Examiner* — Michael McDuffie
(74) *Attorney, Agent, or Firm* — Malhotra & Malhotra IP, LLP; Kushal Malhotra

(57) ABSTRACT

A mount for hanging a stringed instrument on commonly used standard doors that does not require the use of nails, bolts or screws driven into the door panel and consists of a supporting member, a U-shaped yoke attached to one end of the supporting member, the other end of the supporting member has a rectangular shape that fits over the door. An intermediary piece is used to attach the U-shaped yoke to the supporting member. An additional angular brace is optionally provided for additional support preventing movement of the guitar during door opening and closing.

14 Claims, 10 Drawing Sheets

(56) References Cited

U.S. PATENT DOCUMENTS

| | | | | |
|---|---|---|---|---|
| 7,541,529 | B1 * | 6/2009 | Blair | G10G 5/00 224/257 |
| 7,775,491 | B1 * | 8/2010 | Samu | G10G 5/00 248/215 |
| 7,887,017 | B2 * | 2/2011 | Moran | B44C 5/00 248/215 |
| 7,992,833 | B1 * | 8/2011 | Goodman | A47G 25/0614 248/298.1 |
| 9,166,385 | B2 * | 10/2015 | Newman | H02G 1/00 |
| 9,211,023 | B1 * | 12/2015 | Weiss | A47G 25/0614 |
| 10,299,614 | B2 * | 5/2019 | Adams | A47G 25/0614 |
| 10,332,493 | B2 * | 6/2019 | Moberg | F21V 33/0056 |
| 2006/0022098 | A1 * | 2/2006 | De Backer | A47K 17/022 248/215 |
| 2007/0039446 | A1 * | 2/2007 | Samu | G10G 5/00 84/327 |
| 2009/0213598 | A1 * | 8/2009 | Terry | F21V 33/0024 362/419 |
| 2014/0332619 | A1 * | 11/2014 | Yang | A47K 10/10 242/597.8 |
| 2019/0142197 | A1 * | 5/2019 | McClendon | A47B 61/02 248/295.11 |

* cited by examiner

DOOR STRINGED INSTRUMENT MOUNT

TECHNICAL FIELD

The present invention is directed to a simple yet effective device for storing and hanging a stringed-instrument such as a guitar. The invention is elegant in its simplicity and function, essentially allowing an individual to store a guitar as easily as they would hang a shirt or a towel or some such article of clothing. The location of the mount, (i.e. over the top of standard door), allows for easy, plain sight access to the owner's guitar. Moreover, the invention accomplishes its function without the need to drive metal spikes of any sort into the standard door from which it is attached.

BACKGROUND OF THE INVENTION

Stringed-instrument storage has been somewhat of a challenge for musicians of all stripes. Depending on various criteria such as ease of access, frequency of use, safety, security, sales, aesthetics, preservation, overall space and presentation, amateur and professional musicians alike store their stringed-instruments in a variety of ways. Many musicians require space-saving hanging mechanisms for their stringed-instruments, which allow points for quick and easy access. Moreover, musicians often need their particular storage device to function adequately and effectively, without altering the house or apartment fixture from which it is attached. Musicians are often torn between ease of access to their respective stringed-instruments and the space such a storage mechanism takes up in the room. For instance, guitar cases protect the guitar and keep it debris and dust-free. However, the case must be stored under a bed, away from easy, plain site access or alternatively it must be placed on the floor or on a bed, couch or table each of which takes up unnecessary space in the room at issue. Often times, simply leaning up a guitar precariously against a wall are an alternate and inadequate storage option.

Musicians often times own more than one guitar and, in some cases, many guitars, both acoustic and electric and storing them has proven problematic. Although not an elegant solution, many stringed-instruments are routinely propped up against furniture around the home. In order for these stringed-instruments to be hung in plain view, musicians have thus far needed to attach devices to fixtures such as standard doors or walls which require permanent alterations (such as the use of metal spikes driven into walls and standard doors).

It is the mantra of many a guitar enthusiast that keeping a guitar in plain-site increases exponentially the likelihood of picking it up and practicing it versus storing it away under a bed, in a closet, or the like where it is likely to be forgotten about. Renowned guitar instructor Jim Bowler states that " . . . consistency is so important to your success, both mentally and physically; . . . short but frequent sessions always trump marathon practices; . . . keeping your guitar in plain sight is one of the hidden "tricks" to guitar progress." (http://www.jimbowley.com/2012/04/six-steps-to-awesome-4-be-consistent/ site visited Nov. 6, 2014).

To date such easy, plain site access to a guitar without the need to hammer in wall fixtures is accomplished by means of a standard floor guitar stand. Stringed-instruments can be placed in plain view on floor mounts which do not employ permanent fixture alterations. These floor mounts, however eat up space on the floor in the same way that any piece of furniture would do otherwise. Thus there exists a need for a stringed-instrument mount that is (a) space saving, (b) provides plain site ease of access and (c) does so without requiring permanent changes to wall or standard door fixtures in one's dwelling place.

In a review of prior art, it is noted that U.S. Pat. No. 7,775,491 B1 suggests that hanging a guitar from a closet rod which is hung from a mount not unlike a clothes mount hook modified to accommodate a yoke which in turn keeps the guitar suspended from the mount and off of the floor. Such a device saves space and accomplishes hanging a guitar without the need to attach or hammer into fixtures. However, the device does not accomplish ease of access in plain-site. Closets by their very nature hide away items away from plain-site to be accessed only upon the need bases.

U.S. Pat. No. 5,911,396 discloses a closet guitar mount structural frame device, which is rather complex in construction requiring upper a lower frame members which engage one another to provide a mount which is adjustable. However, such a frame mount device must be disassembled in order to enable it to engage and thus be supported by a suitable closet rod and, in operation, the frame members are capable of disengagement which could result in a catastrophic drop of the guitar on the floor. Even more simply put, however, this device is also by its nature a closet mount system, which of course keeps the guitar away from plain-site view.

U.S. Patent Application 20090213598 provides for a musical instrument stand that is both portable and compact. It has a U-shaped yoke whereby a stringed-instrument is hung vertically from the point in which the neck meets the head. While the device is detachable and provides for easy plain-site access to the guitar, the invention application teaches two screw hole openings wherein the portable device is attached to the wall or other such mounting surface. Thus the device requires driving metal pieces into fixtures. Not only does this require the burrowing of holes into the mounting surface, but it complicates installation and detachment of the device when it is no longer needed.

It is thus an object of the present invention to provide a mount which is simple, easy to manufacture and cost effective. It is also an object of the present invention to provide a stringed-instrument mount which performs all of the following functions: (a) Provides a plain-site hanging mechanism on commonly used household standard doors (b) Provides a space saving alternative to floor stands (c) accomplishes these ends without driving metal objects into the mounting surface thus permanently altering fixtures from which it attaches.

This and further objects will be more readily appreciated when considering the following disclosure and appended claims.

SUMMARY OF THE INVENTION

A mount for hanging stringed-instruments on commonly used standard doors. The mount comprises a supporting member, a "U"-shaped yoke as well as an intermediary rectangular box piece. The mount does not require the use of nails, bolts or other such metal spikes which otherwise would be driven into a standard door. The proximal end of the supporting member is configured into a rectangular bridge shaped formation. The formation connects up and around the top surface of the standard door (i.e. the roof of the standard door). For standard doors, the formation at the proximal end of the supporting member consists of a single piece bridge-shaped configuration which wraps over and around the top of a standard door whilst thin enough not to encumber the standard door closing and opening. The resulting geometric design of the proximal end forms an open and hollowed bench-like structure with three sides and four vertices. The distal end of the supporting member lies flat vertically to the standard door face where the mount hangs. At the region closest to the distal end there exists and attached the U-shaped yoke with memory foam surrounding each prong. The U-shaped yoke protrudes horizontally at 90 degrees from the vertical distal end. The U-shaped yoke attaches to the distal end via an intermediary third piece, bolted on the distal end of the supporting member. The intermediary third piece is a rectangular box which rests between the U-shaped yoke and the distal end of the mount. The U-shaped yoke serves to surround a stringed-instrument at the point where the neck meets its head. An optional angular brace has three angular planes formed from one metal piece that provides an additional support for the stringed instrument. The angular brace is mechanically attached to the U shaped yoke and stabilizes the entire mount such that the stringed instrument does not contact the door surface during the normal operation of opening and closing the door.

BRIEF DESCRIPTION OF THE DRAWINGS

FIG. 2 also includes the block intermediary piece to be attached via screw holes to the supporting member as well as the U-shaped yoking piece of FIG. 3.

FIG. 4 also sketches the aforementioned intermediary piece (here shown bolted to the long vertical face of the hanging mechanism. The U-shaped yoke is also seen in its attached form, attached to the intermediary piece.

DETAILED DESCRIPTION OF THE INVENTION

The elegantly simple yet effective hanging device of the present invention is comprised of three main components. The overall configuration has a framework which includes (a) a supporting member that is an asymmetric, bridge shaped piece (which borders at right angles, three edges off of the top of a standard door), (b) an intermediary rectangular block-shaped piece and (c) a U-shaped yoke. These three pieces combine to form a practical solution to hanging a stringed-instrument on a standard door. In an another embodiment and angular brace acts as an additional support that also prevents the stringed instrument from contacting the door.

Figure 2:
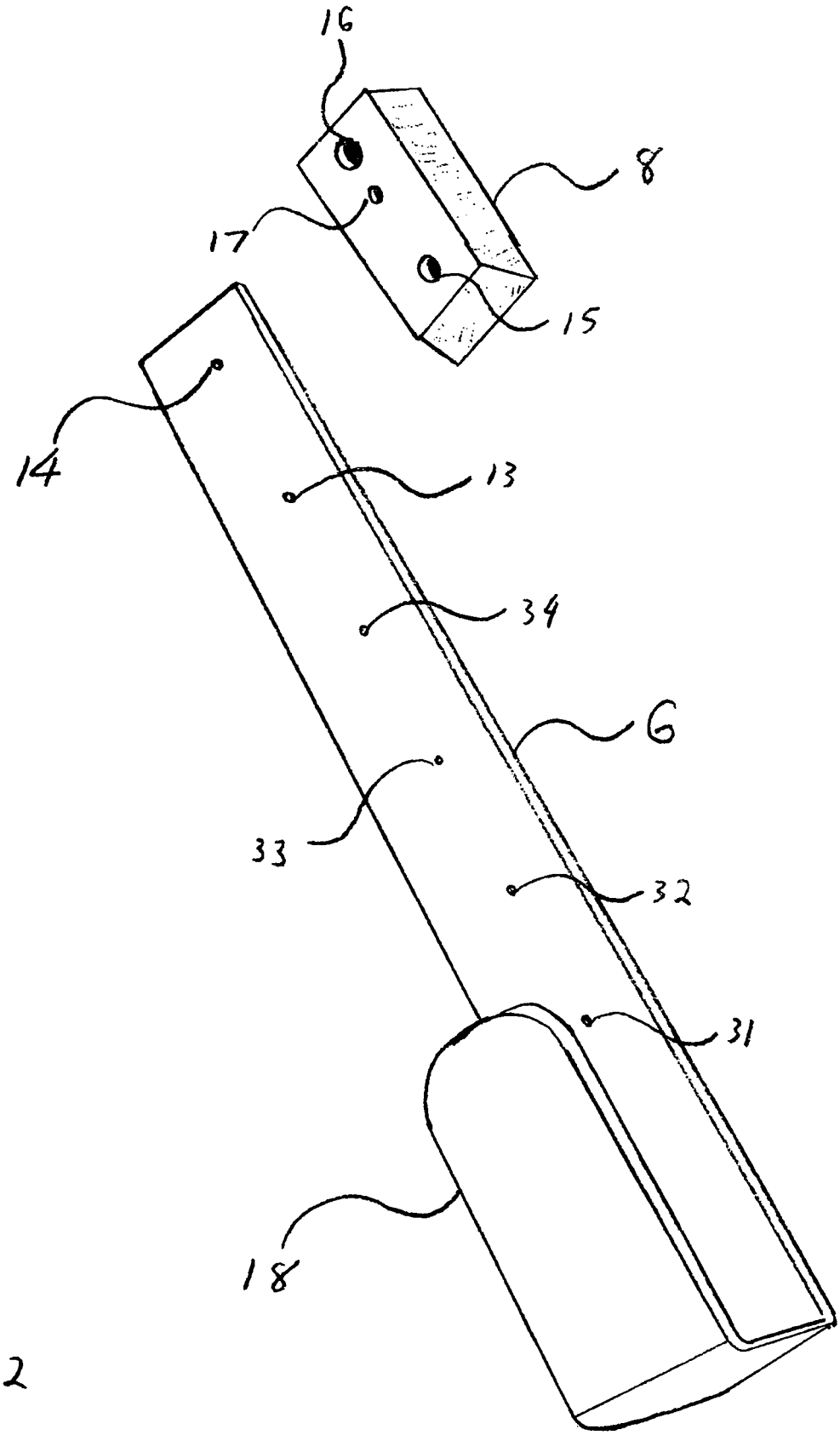
FIG. 2 is a tracing of the proximal end of the supporting member constructed to fit over standard doors.
Figure 3:
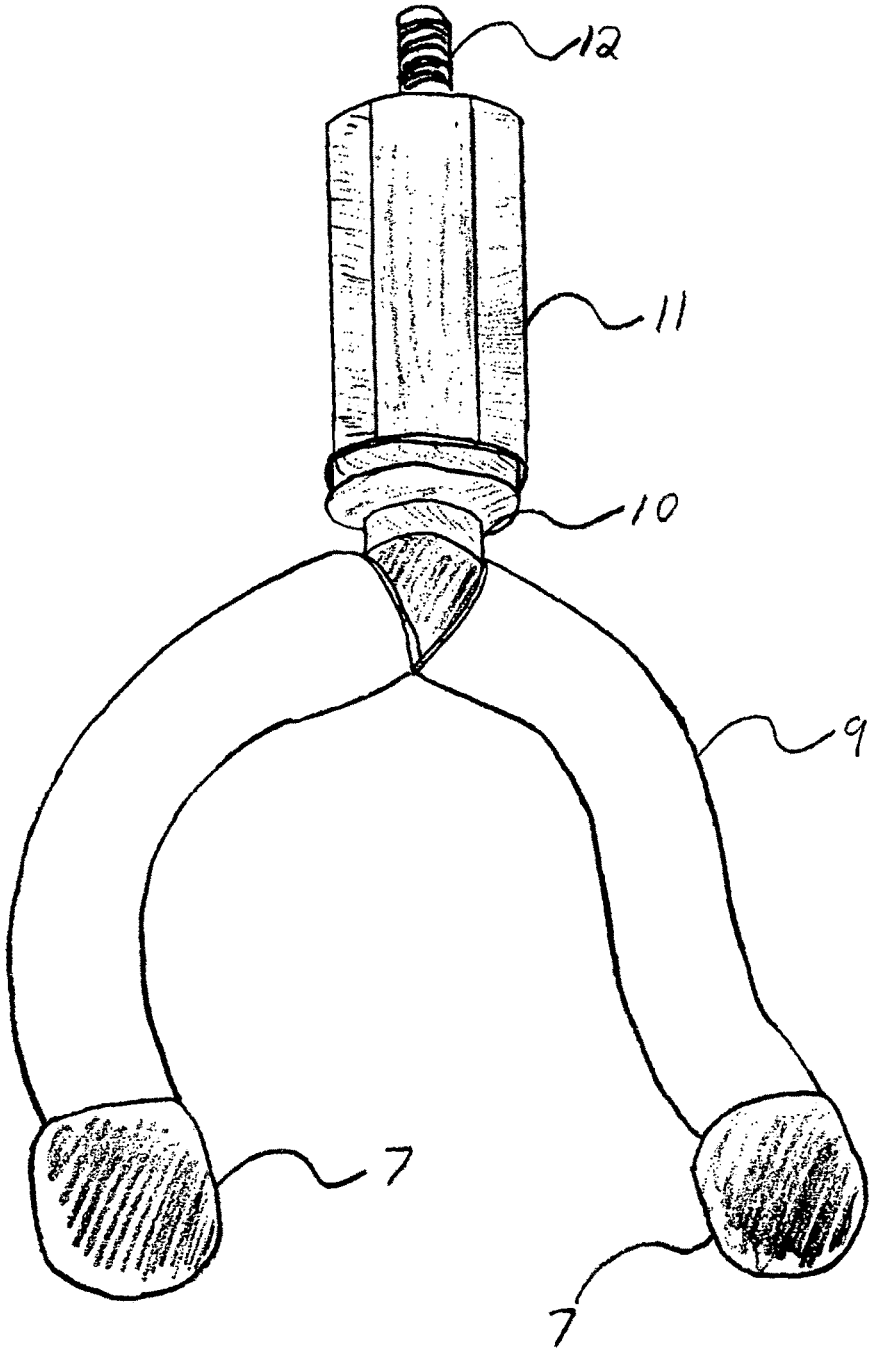
FIG. 3 is a tracing of a U-shaped yoking piece along with a ruler which provides a reference point for the size and scope the piece.

The present invention can be perhaps best appreciated by initially referencing FIGS. 2 and 3. FIG. 3 shows an overall U-shaped yoke comprising a screwed protrusion 12 at its base a striated capsule tightening mechanism 11 which acts as a sheath over a cylindrical metal tube 10 which forks into a U-shaped yoke 9 which is covered by memory foam both to soften and induce the fit of a wide range of stringed-instruments as its flanged wrap around the outside of the stringed-instrument at the point where its head meets its neck. The U-shaped yoke 9 is encapsulated partially at its distal ends with soft capsules 7.

Figure 1:
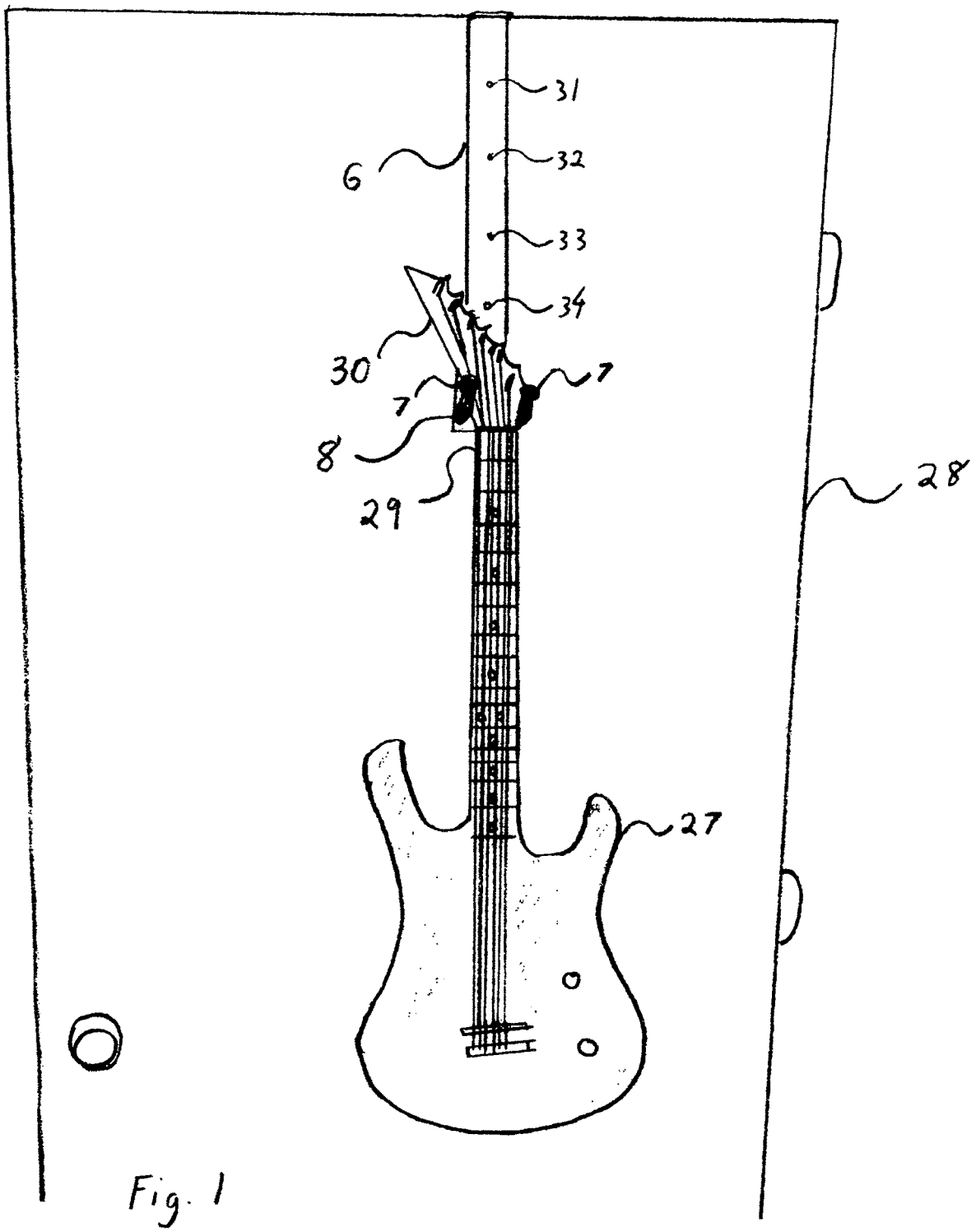
FIG. 1 is a tracing of the guitar mount of the present invention fitted over a standard door and hanging a standard electric guitar at the point where the neck meets the head of the instrument.

FIG. 2 is a tracing which shows a single vertical piece 6 that wraps around and on top of the roof of a standard door. The single long aspect of the vertical piece 6 sits vertically on the standard door on the side where the stringed-instrument is chosen to hang. FIG. 1 depicts the long aspect of the single vertical piece 6 without showing the top end sitting on the roof of the standard, door 28 nor showing the opposite counterbalancing vertical piece which wraps around the door 28 and sits flat on the opposite face of the standard door 28. FIG. 2 shows that the distal end of the long aspect of the vertical piece 6 contains two holes 13 and 14 wherein screws are used to connect piece 6 to intermediary block 8.

Intermediary block 8 has corresponding holes 16 and 15 designed to fit perfectly over holes 13 and 14 respectively of piece 6. An additional hole 17 is also provided in order to allow for a screw attachment position for the protruding screw 12 at the base of the U-shaped yoke of FIG. 3. Intermediary block 8 may be comprised of any light weight and inexpensive material standard in the industry. Such materials include but are not limited to wood, metal, plastic, polymer resin, rubber and the like. The piece is designed to afford a better aspect and angle for the stringed-instrument to hang. It also provided the needed mass which acts to provide foundational support for the weight of the stringed-instrument vis-à-vis the present invention mechanism from which it hangs. Allowing for the necessary interpretation for those skilled in the art the intermediary block is comprised of dimensions of 1.75" width, 4" height and 0.75" thickness. Such measurements provide a general scope for later specifications of a skilled artisan.

Such a mechanism is shown in working form in FIG. 1. Here the weight of an electric guitar 27 is shown comfortably and securely hanging from the present invention which is attached to a standard door 28. The U-shaped yoke's capsule coverings 7 are seen in the visible aspect of this photograph FIG. 1. The U-shaped yoke grasps the guitar 27 at the point where its neck 29 meets its head 30.

Figure 4:
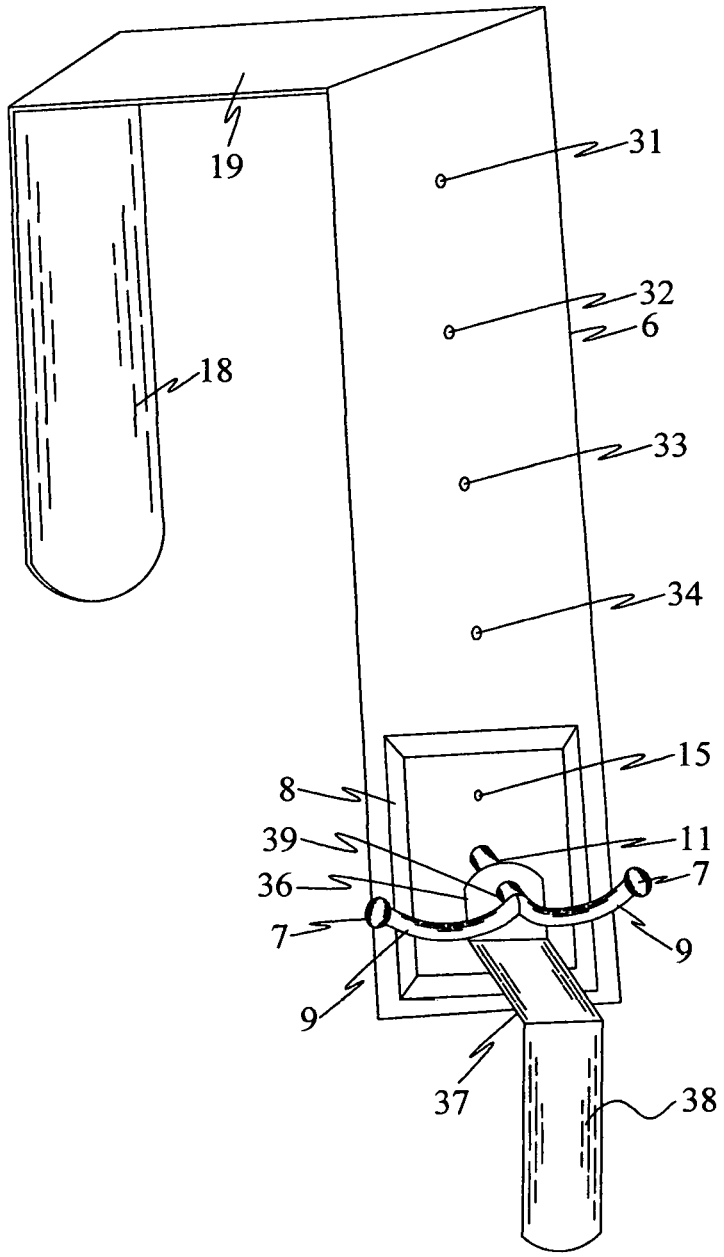
FIG. 4 is a perspective view of supporting member of the present invention drawn. It depicts each part of the bridge-shaped right-angled piece which acts to wrap up and over a standard door. All pieces are fused to each other at 90 degree angles. The longest fused component sits vertically down on the side of the standard door from which hangs the stringed-instrument. This piece is designed to sit vertically and lay flat on the face of a standard door. A top fused piece sits horizontally on top of the standard door. A third fused piece sits vertically on the opposite face of the standard door in order to provide leverage and a counterbalance point for the vertical piece which faces the stringed-instrument on the other side.

FIG. 4 is a perspective view of the guitar mount of the present invention drawn to face the viewer at a partial angle. It depicts each part of the bridge-shaped right-angled piece which acts to wrap up and over a standard door. The long aspect of the single vertical piece 6 is seen at the forefront with intermediary rectangular block 8 and the U-shaped yoke. Each are shown attached to each other as well as attached to the distal end of the long vertical piece 6. The piece is sketched in loose form, free from standard door 28. The top end piece 19 of the bridge sits horizontally on the roof of a standard, door 28 (not shown here). The opposite and shorter counterbalancing vertical piece 18 of the bridge wraps around standard door 28 (not shown here) and sits flat on the opposite face of standard door 28. The distal end of the long aspect of the vertical piece 6 contains two holes wherein screws are used to connect piece 6 to intermediary block 8 via screw hole 16 at the far distal end and screw hole 15 at the near distal end which sits higher and closer to the top of piece 6 when it hangs vertically from the top of a standard door. All pieces (18, 19 and 6) are fused to each other at 90 degree angles. The longest fused component 6 sits vertically down on the side of the standard door from which hangs the stringed-instrument. This piece 6 is designed to sit vertically and lay flat on the face of a standard door. A top fused piece 19 sits horizontally on top of the standard door. A third fused piece 18 sits vertically on the opposite face of the standard door in order to provide leverage and a counterbalance point for the vertical piece 6 which faces the stringed-instrument on the other side. FIG. 4 also sketches the aforementioned intermediary piece 8 (here shown bolted to the long vertical face 6 of the hanging mechanism). The U-shaped yoke is also seen in its attached form, attached to the intermediary piece 8. The U-shaped yoke is comprised of the following: A screw that attaches horizontally to a single screw hole located on the intermediary piece 8 in between holes 15 and 16 respectively. Screw holes 15 and 16 each function as holes for attachment to the long vertical piece 6 of the hanging mechanism. From the screw in point protrudes horizontally a striated capsule tightening mechanism 11. The singular horizontal tube 11 forks into a U-shaped yoke 9 which is covered by memory foam (not herein sketched in FIG. 4) which acts both to soften and induce the fit of a wide range of stringed-instruments as its flanges wrap around the outside of the stringed-instrument at the point where its head meets its neck. The U-shaped yoke is encapsulated partially at its distal ends with soft capsules 7. Dimensions of the bridge mechanism are as follows: the length of the counterbalancing fused vertical piece 18 of the U-shaped yoke is 4". The length of the top horizontal piece 19 of the U-shaped yoke is 1 and $\frac{5}{8}_{th}$", and the length of the long vertical piece 6 is 14". Such measurements provide a general scope for later specifications of a skilled artisan.

Figure 5:
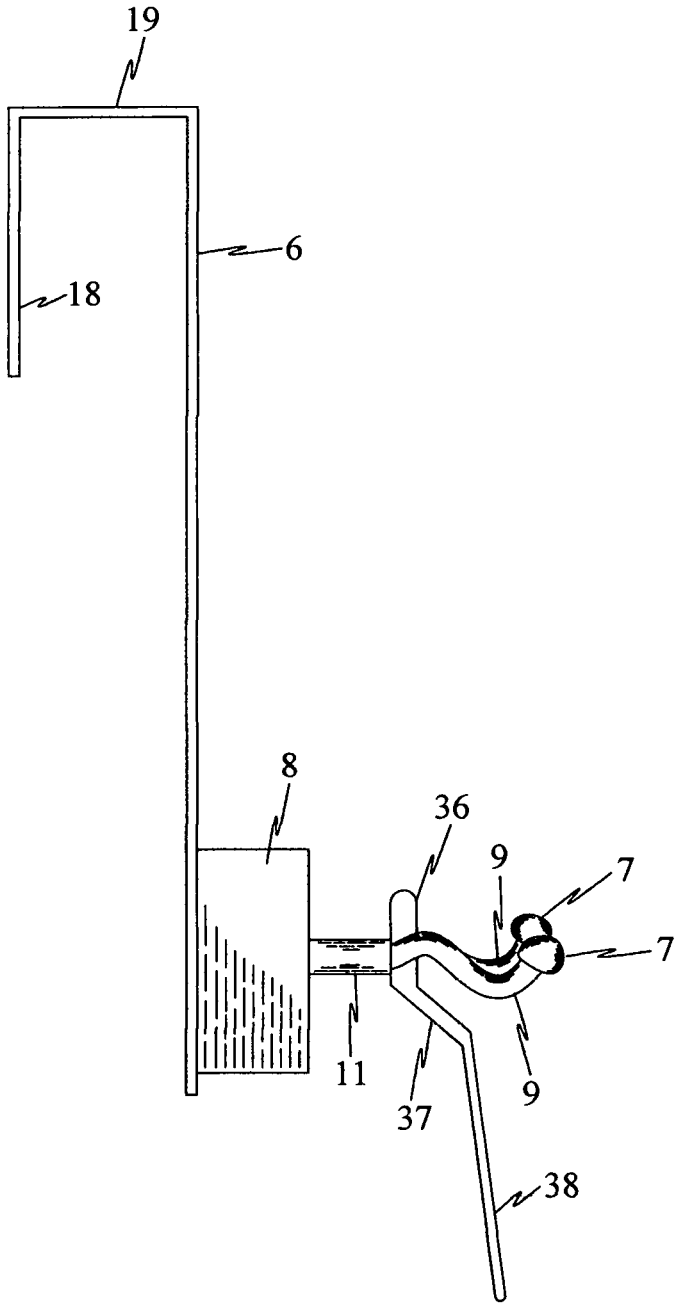
FIG. 5 is a sectional view of the guitar mount of the present invention showing the supporting member placed on top of a standard door and the intermediary piece bolted to the supporting member. The U-shaped yoke is also seen in its attached form, attached to the intermediary piece.

FIG. 5 is a sectional view of the guitar mount of the present invention that shows each part of the bridge-shaped right-angled piece which acts to wrap up and over a standard door. The long aspect of the single vertical piece 6 is on the right with intermediary rectangular block 8 shown with a perspective of its scope and thickness (i.e. $\frac{3}{4}_{th}$"). The U-shaped yoke is sketched and protrudes horizontally away and to the right of the intermediary block 8. Each are shown attached to each other as well as attached to the distal end of the long vertical piece 6. The piece is sketched in loose form, free from standard door 28. The top end piece 19 of the bridge sits horizontally on the roof of a standard, door 28 (not shown here). The opposite and shorter counterbalancing vertical piece 18 of the bridge wraps around standard door 28 (not shown here) and sits flat on the opposite face of standard door 28 (here sketched on the left hand side). This piece 6 is designed to sit vertically and lay flat on the face of a standard door. A top fused piece 19 sits horizontally on top of the standard door. A third fused piece 18 sits vertically on the opposite face of the standard door in order to provide leverage and a counterbalance point for the vertical piece 6 which faces the stringed-instrument on the other side of the standard door. FIG. 5 also sketches the aforementioned intermediary piece 8 (here shown sandwiched between piece 6 and the U-shaped yoke). Protruding horizontally out of the right edge of the intermediary piece 8 is a striated capsule tightening mechanism 11 (a component of the U-shaped yoke). The striated capsule tightening mechanism 11 acts as a sheath encapsulating inner tube 10. Inner tube 10 forks into a U-shaped yoke 9. Spokes 9 are covered by memory foam (not shown herein sketched in FIG. 5). The foam acts to both to soften and induce the fit of a wide range of stringed-instruments as its flanges wrap around the outside of the stringed-instrument at the point where its head meets its neck. The U-shaped yoke is encapsulated partially at its distal ends with soft bulbous capsules 7. Dimensions of the bridge mechanism are as follows: the length of the counterbalancing vertical piece 18 is 4". The length of the top horizontal piece 19 is 1 and $\frac{5}{8}_{th}$", and the length of the long vertical piece 6 is 14". The thickness of the metal (preferably standard steel or stainless steel or galvanized steel) piece bridge mechanism which wraps around a standard door is approximately $\frac{1}{14}_{th}$". The thickness of the rectangular block intermediary piece 8 is $\frac{3}{4}_{th}$". Such measurements provide a general scope for later specifications of a skilled artisan.

Figure 6:
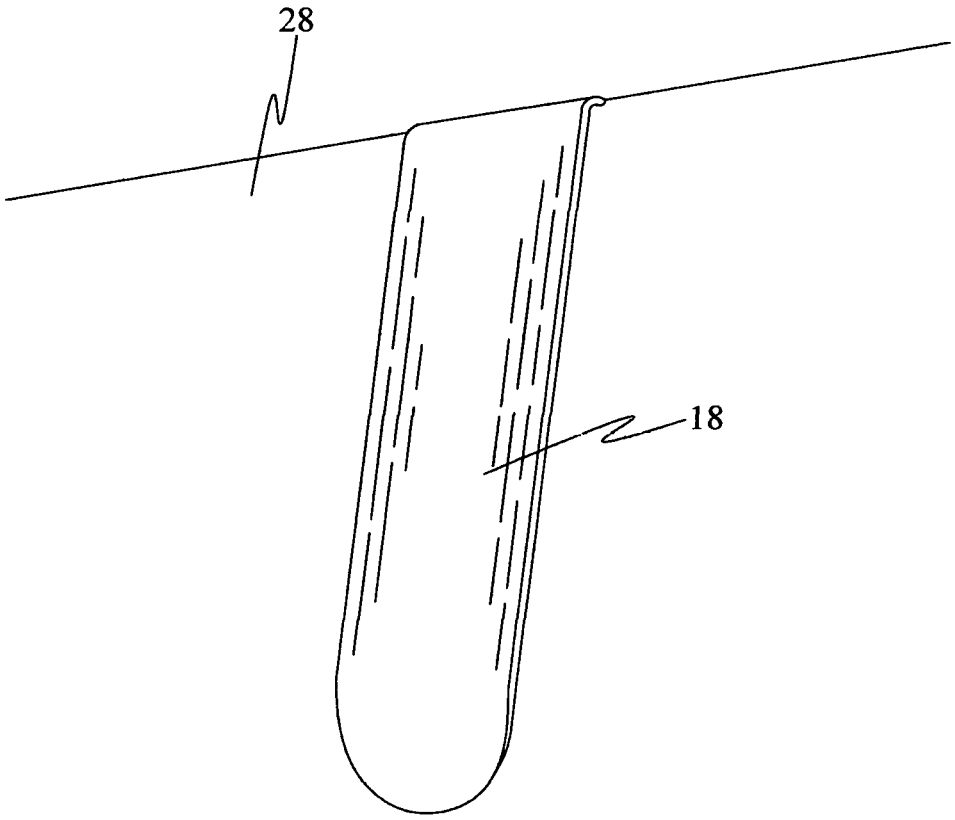
FIG. 6 is a tracing of the present invention showing the supporting member's proximal end on the opposite face of the standard door. This component of the invention provides leverage and a counterbalance point for the vertical piece which faces the stringed-instrument on the other side of the door.

FIG. 6 is a tracing of the present invention showing the third fused piece 18 which sits vertically on the opposite face of the standard door 28 (i.e. the face of the standard door from which the stringed-instrument does not hang). The opposite and shorter counterbalancing vertical piece 18 of the bridge wraps around standard door 28 and sits flat on the opposite face of standard door 28. This component of the invention provides leverage and a counterbalance point for the vertical piece 6 which faces the stringed-instrument on the other side (not shown here in FIG. 6).

Figure 7:
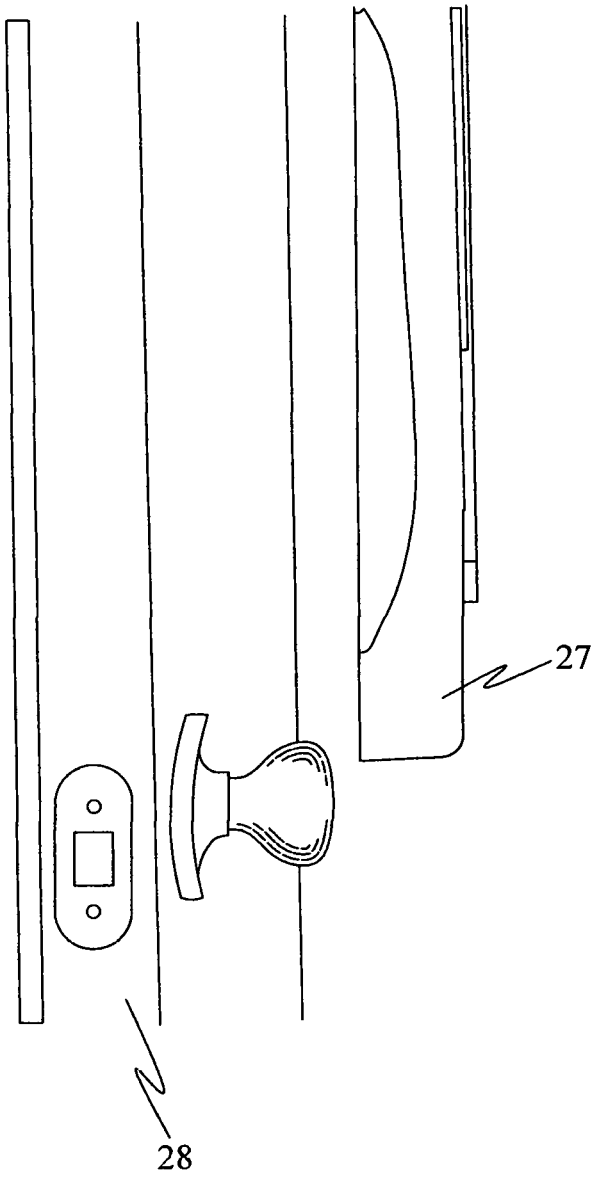
FIG. 7 is a tracing of the present invention showing the free guitar body end hanging several inches free and away from the standard door.

FIG. 7 is a tracing of the present invention showing the free guitar body end 27 hanging vertically toward the floor. Note that the base underside of the guitar body 27 whose side faces the standard door hangs several inches free and away from the standard door 28.

Figure 8:
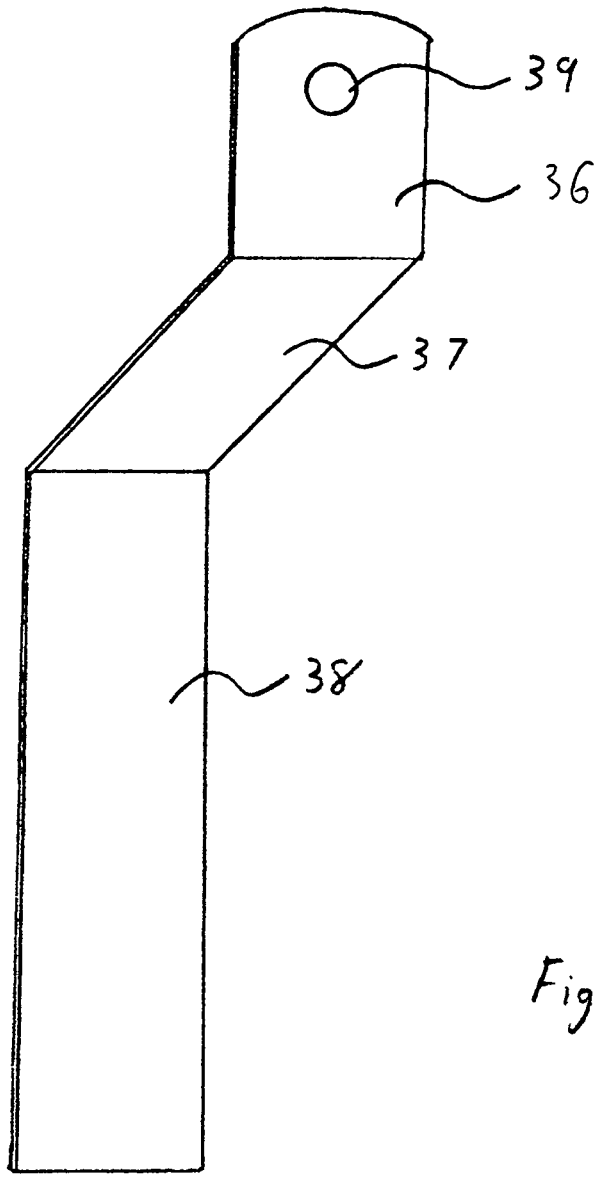
FIG. 8 is a tracing of the guitar mount of the present invention fitted over a standard door and hanging a standard electric guitar at the point where the neck meets the head of the instrument. The U-shaped yoke is seen in its attached form, attached to the intermediary piece. The U-shaped yoke and intermediary piece are shown supporting the weight of a standard electric guitar.

FIG. 8 is a tracing of the guitar mount of the present invention fitted over a standard door 28 and hanging a standard electric guitar 27 at the point where the neck 29 meets the head 30 of the instrument. This tracing is provided in order to show a profile, silhouette viewpoint where the viewer sees the invention from the side functioning and successfully supporting a working guitar. The U-shaped yoke is seen in its attached form, where a striated capsule tightening mechanism 11 protrudes horizontally away from the standard door attached at its base to the intermediary piece 8. The intermediary piece 8 is attached to the vertical face 6 of the bridge-shaped hanging mechanism. Note that neither the top horizontal piece 19 nor the counterbalancing vertical piece 18 are shown here in FIG. 8 wrapping above and around standard door 28. The U-shaped yoke and intermediary piece 8 are shown supporting the weight of a standard electric guitar.

Figure 9:
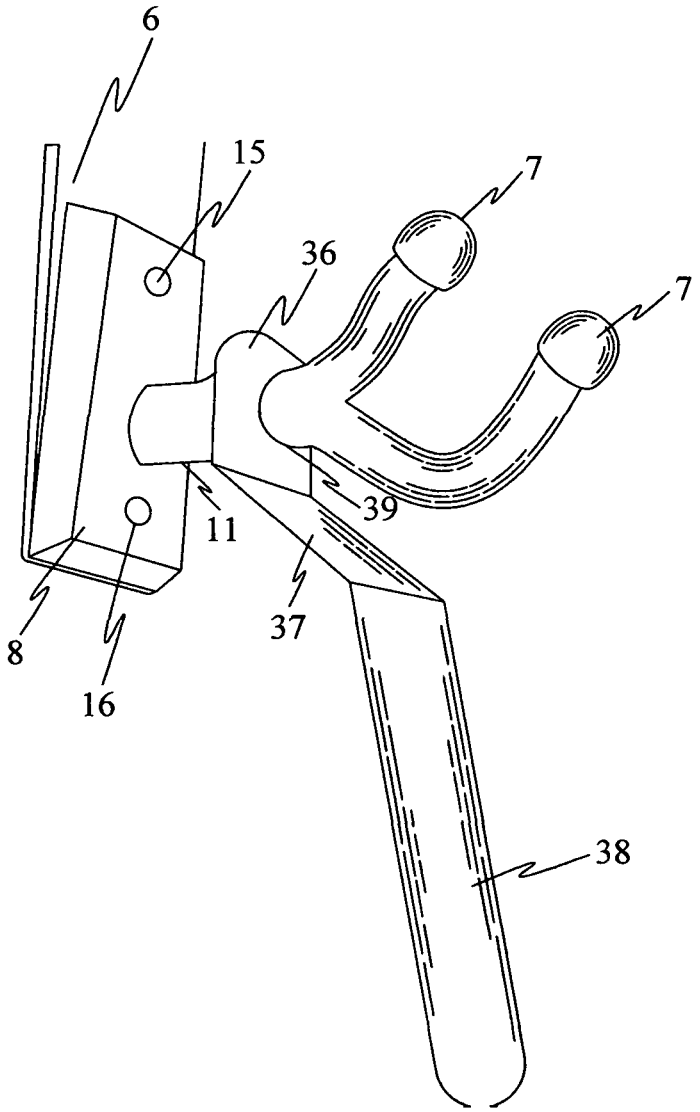
FIG. 9 is a sectional view of an alternative embodiment of the present invention. There is an additional aspect to FIG. 4 wherein a plurality of evenly spaced holes on the fused vertical component of the bridge-shaped mount is laid out in a linear array. These holes allow for the intermediary member and therefore the U-shaped yoke it attaches to be positioned higher or lower along the y-axis of the vertical fused component of the bridge-shaped mount.

FIG. 9 is a drawing of the guitar mount of the present invention drawn to face the viewer at a partial angle. It depicts each part of the bridge-shaped right-angled piece which acts to wrap up and over a standard door. The long aspect of the single vertical piece 6 is seen at the forefront with intermediary rectangular block 8 and the U-shaped yoke. Each are shown attached to each other as well as attached to the distal end of the long vertical piece 6. The piece is sketched in loose form, free from standard door 28. The top end piece 19 of the bridge sits horizontally on the roof of a standard, door 28 (not shown here). The opposite and shorter counterbalancing vertical piece 18 of the bridge wraps around standard door 28 (not shown here) and sits flat on the opposite face of standard door 28. The distal end of the long aspect of the vertical piece 6 contains two holes wherein screws are used to connect piece 6 to intermediary block 8 via screw hole 16 at the far distal end and screw hole 15 at the near distal end which sits higher and closer to the top of piece 6 when it hangs vertically from the top of a standard door. Holes 31, 32, 33, and 34 respectively are lines vertically and spaced at regular intervals along the y-axis of the vertical fused member of the mount. These sets of holes can house screws and act in tandem to attach the intermediary piece 8 and its accompanying U-shaped yoke attachment. Thus any set of corresponding holes such as 15 and 16 (shown here as the attachment points for the intermediary piece 8 and its accompanying U-shaped yoke attachment) may act as the coupling points for attachment. In the alternative the intermediary piece and its U-shaped yoke attachment can optionally be placed at coupling points [34 and 15], [33 and 34], [32 and 33] or [31 and 32] respectively. Coupling pints may optionally be [34 and 15], [32 and 33] as well in the alternative. The results of such optional attachment points provide the musician to yoke the stringed-instrument at the varying heights along the vertical piece of the bridge-shaped mount. These options provide the user with varying choices as to the height wherein he/she chooses to hang his/her stringed-instrument for standard door. 28. All pieces (18, 19 and 6) are fused to each other at 90 degree angles. The longest fused component 6 sits vertically down on the side of the standard door from which hangs the stringed-instrument. This piece 6 is designed to sit vertically and lay flat on the face of a standard door. A top fused piece 19 sits horizontally on top of the standard door. A third fused piece 18 sits vertically on the opposite face of the standard door in order to provide leverage and a counterbalance point for the vertical piece 6 which faces the stringed-instrument on the other side. FIG. 4 also sketches the aforementioned intermediary piece 8 (here shown bolted to the long vertical face 6 of the hanging mechanism). The U-shaped yoke is also seen in its attached form, attached to the intermediary piece 8. The U-shaped yoke is comprised of the following: A screw that attaches horizontally to a single screw hole located on the intermediary piece 8 in between holes 15 and 16 respectively. Screw holes 15 and 16 each function as holes for attachment to the long vertical piece 6 of the hanging mechanism. From the screw in point protrudes horizontally a striated capsule tightening mechanism 11. The singular horizontal tube 11 forks into a U-shaped yoke 9 which is covered by memory foam (not herein sketched in FIG. 4) which acts both to soften and induce the fit of a wide range of stringed-instruments as its flanges wrap around the outside of the stringed-instrument at the point where its head meets its neck. The U-shaped yoke is encapsulated partially at its distal ends with soft capsules 7. Dimensions of the bridge mechanism are as follows: the length of the counterbalancing fused vertical piece 18 of the U-shaped yoke is 4". The length of the top horizontal piece 19 of the U-shaped yoke is 1 and $^{5}/_{8th}$", and the length of the long vertical piece 6 is 14". Such measurements provide a general scope for later specifications of a skilled artisan.

Figure 10:
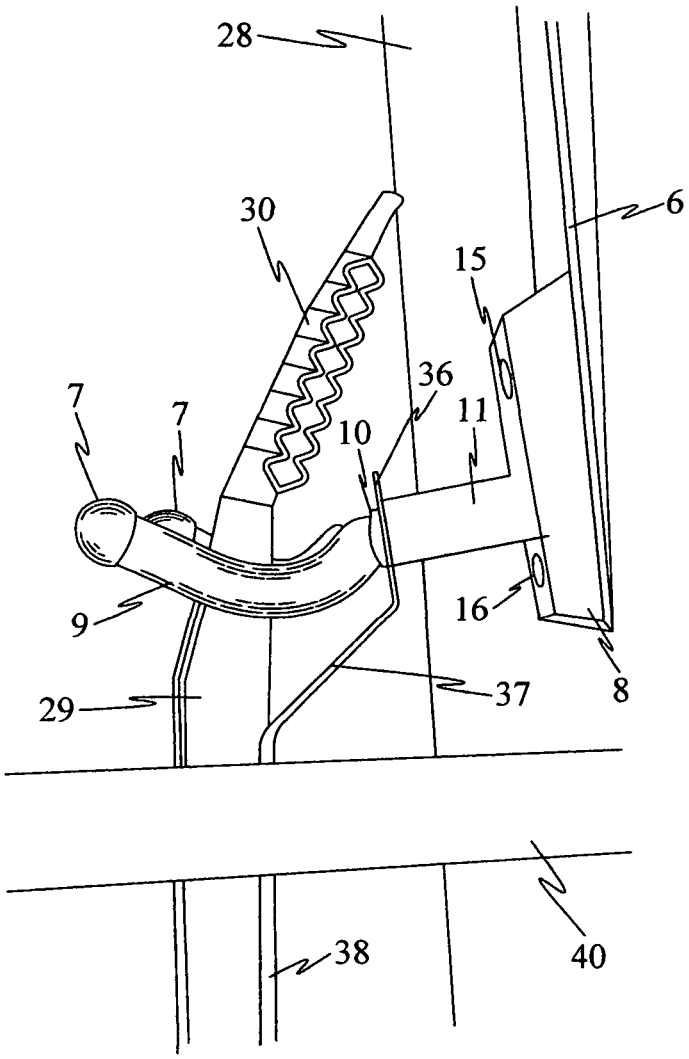
FIG. 10 is an alternative embodiment of the present invention as shown above in FIG. 9. It is a mechanical drawing sketch of the guitar mount of the present invention drawn to face the viewer at a partial angle wherein all of the elements of FIG. 4 as well as FIG. 9 above are incorporated by reference. There is an additional aspect wherein a plurality of evenly spaced holes on the fused vertical component of the bridge-shaped mount is laid out in a linear array and an additional intermediary member and U-shaped yoke is attached to the vertical fused piece of the bridge-shaped mount. Such a configuration provides the user with an added option to adjust the yoke up and down the vertical surface of the mount so as to meet his/her tastes and/or requirements (i.e. the need to space the guitar safely above the floor).

FIG. 10 is a sectional view of the guitar mount of the present invention drawn to face the viewer at a partial angle. It depicts each part of the bridge-shaped right-angled piece which acts to wrap up and over a standard door. The long aspect of the single vertical piece 6 is seen at the forefront with intermediary rectangular block 8 and the U-shaped yoke. Each are shown attached to each other as well as attached to the distal end of the long vertical piece 6. The piece is sketched in loose form, free from standard door 28 (not shown here). The top end piece 19 of the bridge sits horizontally on the roof of a standard, door 28 (not shown here). The opposite and shorter counterbalancing vertical piece 18 of the bridge wraps around standard door 28 (not shown here) and sits flat on the opposite face of standard door 28. The distal end of the long aspect of the vertical piece 6 contains two holes wherein screws are used to connect piece 6 to intermediary block 8 via screw hole 16 at the far distal end and screw hole 15 at the near distal end which sits higher and closer to the top of piece 6 when it hangs vertically from the top of a standard door. Holes 31, 32, 33, and 34 respectively are lines vertically and spaced at regular intervals along the y-axis of the vertical fused member of the mount. These sets of holes can house screws and act in tandem to attach the intermediary piece 8 and its accompanying U-shaped yoke attachment. Thus any set of corresponding holes such as 15 and 16 (shown here as the attachment points for the intermediary piece 8 and its accompanying U-shaped yoke attachment) may act as the coupling points for attachment. In the alternative the intermediary piece and its U-shaped yoke attachment can optionally be placed at coupling points [16 and 15], [34 and 15], [33 and 34], [32 and 33] or [31 and 32] respectively. Coupling pints may optionally be [34 and 15], [32 and 33] as well in the alternative. The results of such optional attachment points provide the musician to yoke the stringed-instrument at the varying heights along the vertical piece of the bridge-shaped mount. These options provide the user with varying choices as to the height wherein he/she chooses to hang his/her stringed-instrument for swinging door 28.

Thus in the instance drawn in in FIG. 10 the mount (comprised of an intermediary piece 8 and a U-shaped yoke attachment) sits vertically and taking up any two consecutive coupling [16 and 15], [34 and 15], [33 and 34], [32 and 33] or [31 and 32] respectively. Coupling pints may optionally be [34 and 15], [32 and 33] as well in the alternative. As one example shown here, yoke one combination connects at holes 15 and 16. The U-shaped yoke would wrap around a stringed-instruments neck 29 further towards the guitar body 27 (the stringed-instrument is not shown here in FIG. 10) or alternatively this very same yoke combination may attached at holes 33 and 34. This mount hangs the stringed-instrument at the point where its neck 29 meets its head 30 (guitar not shown here). Note that any two holes (two sequential combinations) can be used as points of attachment for the hanging mechanism system described in this embodiment. For instance, the user musician may choose to hang yoke [16 and 15], [34 and 15], [33 and 34], [32 and 33] or [31 and 32] respectively. Coupling points may optionally be [34 and 15], [32 and 33].

All pieces (18, 19 and 6) are fused to each other at 90 degree angles. The longest fused component 6 sits vertically down on the side of the standard door from which hangs the stringed-instrument. This piece 6 is designed to sit vertically and lay flat on the face of a standard door. A top fused piece 19 sits horizontally on top of the standard door. A third fused piece 18 sits vertically on the opposite face of the standard door in order to provide leverage and a counterbalance point for the vertical piece 6 which faces the stringed-instrument on the other side. FIG. 4 also sketches the aforementioned intermediary piece 8 (here shown bolted to the long vertical face 6 of the hanging mechanism). The U-shaped yoke is also seen in its attached form, attached to the intermediary piece 8. The U-shaped yoke is comprised of the following: A screw that attaches horizontally to a single screw hole located on the intermediary piece 8 in between holes 15 and 16 respectively. Screw holes 15 and 16 each function as holes for attachment to the long vertical piece 6 of the hanging mechanism. From the screw in point protrudes horizontally a striated capsule tightening mechanism 11. The singular horizontal tube 11 forks into a U-shaped yoke 9 which is covered by memory foam (not herein sketched in FIG. 4) which acts both to soften and induce the fit of a wide range of stringed-instruments as its flanges wrap around the outside of the stringed-instrument at the point where its head meets its neck. The U-shaped yoke is encapsulated partially at its distal ends with soft capsules 7. Dimensions of the bridge mechanism are as follows: the length of the counterbalancing fused vertical piece 18 of the U-shaped yoke is 4". The length of the top horizontal piece 19 of the U-shaped yoke is 1 and $^{5}/_{8th}$", and the length of the long vertical piece 6 is 14". Such measurements provide a general scope for later specifications of a skilled artisan.

Note that all of the pieces which comprise said invention may be composed in part or in whole of any combination or even composite of the following materials standard to those skilled in the art: light weight and inexpensive materials standard in the industry include wood, metal, plastic, polymer resin, rubber and the like. The elegance and simplicity of the present invention should also be quite apparent noting that the three piece combination structure herein described designed for use on standard doors is inexpensive to fabricate. The three piece combination structure herein described provides a selectively removable and yet locking relationship between parts to prevent the possibility of a catastrophic loss of a stringed-instrument through its disengagement from the mount device of the present invention.

The bridge-shaped fused mechanism which wraps around a standard door and consists of fused vertical counterbalancing piece 18, top horizontal piece 19, and the long vertical piece 6 preferably is formed from 16 gauge steel. Such materials provide a general scope for later specifications of a skilled artisan. Those skilled in the art may acknowledge the need for steel (preferably standard steel or stainless steel or galvanized steel) because of the fact that certain guitars and stringed-instruments meet and exceed 15 lbs. and thus requiring the need for steel (preferably standard steel or stainless steel or galvanized steel) and other similar strong, reinforced materials which can be made thin yet with adequate tensile strength.

Note that the memory foam which is made to wrap around the legs of the U-shaped yoke 9 may be modular and accommodated for the various thickness differences in stringed-instruments neck/head aspects ratios and respective measurements. The memory foam in question may be fitted to accommodate very thin neck/head designs such as violins or alternatively fitted to accommodate the other end of the thickness spectrum. Perhaps the U-shaped yoke member's mouth and combination memory foam wrap may be fitted wide enough to accommodate cellos, bass guitars and other such large neck/head components. Ideally of course the design shall be made to fit the dimensions of the most popular stringed-instruments in the world; the standard acoustic and electric guitars. The fact that the U-shaped yoke screws as a separate piece into the intermediary block 8, allows modularity in form. For instance the U-shaped yoke can be replaced by any type of functional yoke, such as a hook or a single flange ore a three pronged form or any other such modular yoke.

As can be inferred by absence of mention, the present invention does not teach any attachment to a standard door wherein metal objects like nails, bolts or screws are required to maintain the hanging mechanism to the fixture. Screws are needed to fashion the present invention, but no metal spikes of any sort are required to be driven into the standard door which would otherwise cause a permanent alteration to a fixture. The lack of a need for permanent alteration by means of nails, bolts and screws, affords the musician versatility, freedom and the peace of mind in the knowledge that using the present invention shall not damage or alter any permanent dwelling fixture. As an advantageous embodiment of the present invention the intermediary member 8 acts as an ad hoc substitute for a standard door fixture. The purpose of a metal spike insert into a fixture is to provide foundational leverage and upward force necessary for a mount to counterbalance the downward force produced by stringed-instruments of various weights, shapes and sizes. The average weight of an acoustic guitar for instance is between 5 and 7 lbs. The average weight of an electric guitar is between 7-9 lbs. Certain specialty guitars can weigh in excess of 12 lbs. Downward force is produced when a representative guitar 27 is hung from the point at which its respective neck 29 meets its head 30. This force would overwhelm the ability of a yoke of the present invention attached directly to an asymmetric, bridge shaped piece (which borders at right angles, three edges off of the top of a standard door) to themselves attach and support a standard guitar 27 from a standard door 28. The intermediary member attachment 8 and the screws that are driven into it from both the U-shaped yoke and the asymmetric bridge shaped piece (which borders at right angles, three edges off of the top of a standard door) serve to simulate the support and foundation that a fixture otherwise would. Because metal spikes only penetrate the intermediary piece 8 and not the standard door fixture 28 no permanent alterations are affected upon a standard door 28.

The depth of the intermediary piece approximately ¾". The length of the U-shaped yoke is approximately 5" after the screw 12 (see FIG. 3) is driven into the intermediary member 8 at hole 17 (see FIG. 2). This length protruding out and away from standard door 28 provides space allowing the string instrument to hang away from the standard door. The distance from the standard door measured from the underside of the point at which its neck 29 meets its head 30 and the vertical surface of the standard door 28 is approximately 3.5". Depending on the nature of the stringed-instrument, the distal end hangs freely in the direction closest to the floor. The distance from the surface of the standard door 28 and the underside of the distal end of the stringed-instrument's body will be variable.

Note that the stringed-instrument mount herein described in the present invention provides moderate stability and support for the stringed-instrument it hangs. However, a standard swinging door is a moving fixture. As such the protection and safety from damage of a hanging stringed-instrument, which may be caused when a swinging fixture is abruptly and/or powerfully opened and/or shut, shall be purveyed by the user of the present invention. An optional angular brace as shown in FIGS. 11-14 acts as another embodiment of the present invention with the ability to induce a spring-like fit, adding more support to the stringed instrument thereby securing it and preventing it from making contact with the door.

FIG. 11 is a perspective view of an angular brace that is an optional added support for the mount. The angular brace has three planes at the shown angles. The brace is comprised of a single piece of 0.14 or 0.16 gauge hot rolled steel which hangs vertically north and south and parallel to door 28. Plane 1 which is comprised of part 36 of the angular brace has a ¼th inch hole 39 cut at its width's center and towards the upper portion of the piece (from a vertical standpoint). Plane 1 is 1.5 inches of vertical length, 2 inches wide and has a height of between. 14 and 0.16 inches. Note also that the top portion of plane 1 is preferably rounded in form. Plane 2 comprised of part 37 of the angular brace protrudes at an obtuse angle away plane 1 (i.e. part 36) as well as from the door 28. The angle as shown in FIG. 11 protrudes 135° away from the north and south aspect of the door 28. The 135° between plane 2 (i.e. part 37) as it protrudes 135° away from the door leaving an acute 65° angle between the imaginary vertical plane which represents the north and south aspect of the door 28. The 135° between plane 2 (i.e. part 37) as it protrudes away from plane 1 (i.e. part 36) at a downward angle creates a slide effect and a 1.5021 inch vertical drop between the vertical plane of plane 1 (i.e. part 36) and the vertical plane of 3 (i.e. part 38). Part 38 is curved in a concave fashion as it is designed to fashion itself to fit the underbelly of a stringed instrument's neck (29) which is rounded in form. Part 38 hangs more or less vertically and its dimensions are 4.75 inches in length, 2 inches in width and between 1.4 and 0.16 inches in height. The optional angular brace, as is common in the field of hanging support mechanics, may be outfitted with a neoprene sleeve or a foam sticker or some other such moldable softening medium. Such measures serve to protect the back of the neck (29) of the stringed instrument and cushion it thereby preventing it from being scratched or nicked as it sits upon the concave surface of the angular brace. Note that all dimensions are provided to give an exemplary model of the present configuration of the invention. Those skilled in the art may perceive alterations and ranges in these dimensions in order to fit their unique set of circumstances.

FIG. 12 is a tracing showing the optional angular brace attached to the U-shaped yoke 9 and the intermediary block. It shows the angular brace set in place between the U-shaped yoke 9 and the striated capsule tightening mechanism 11. The ¼th inch hole 39 cut at the center width and residing toward the upper region of part 36 of the angular brace allows the cylindrical metal tube 10 at the base of the U-shaped yoke 9 to screw though said hole 39. Upon tightening leaves the angular brace secure as it is wedged between the U shaped yoke 9 and the striated capsule tightening mechanism 11. Apart from this optional angular brace configuration, all other parts of the door mount of the present invention exist as described above. The long aspect of the single vertical piece 6 sits flat screwed vertically behind intermediary rectangular block 8 shown with a perspective of its scope and thickness (i.e. $\frac{3}{4}_{th}$"). The U-shaped yoke 9 is sketched and protrudes horizontally away and to the right of the intermediary block 8. Each are shown attached to each other as well as attached to the distal end of the long vertical piece 6. The distal end of the long aspect of the vertical piece 6 contains two holes wherein screws are used to connect piece 6 to intermediary block 8 via screw hole 16 at the far distal end and screw hole 15 at the near distal end which sits higher and closer to the top of piece 6 when it hangs vertically from the top of a standard door. All pieces (18, 19 and 6) are fused to each other at 90 degree angles. The U-shaped yoke 9 is encapsulated partially at its distal ends with soft capsules 7. Part 37 is shown protruding away from plane 1 (i.e. part 36) at a downward angle creates a slide effect between the vertical plane of plane 1 (i.e. part 36) and the (more or less) vertical plane 3 (i.e. part 38). Part 38 is curved in a concave fashion as it is designed to fashion itself to fit the underbelly of a stringed instrument's neck (29) which is rounded in form. Part 38 hangs more or less vertically down.

FIG. 13 is a tracing showing the stringed instrument hanging on the U-shaped yoke and the angular brace acting as the additional support. Here the optional angular brace is shown in action wherein part 38's concave end cups the curved underbelly of stringed instrument's neck 29. The downward force formed from the weight of the stringed instrument is counterbalanced by the spring-like upward force effect created by the slight angle of part 38 of the angular brace as it hangs down more or less vertically down. The slight obtuse angle away from the pure vertical y-axis plane fashioned by part 38 creates this spring-like effect when a stringed instrument hangs from the present invention when the optional angular brace is incorporated into the model. Apart from this optional angular brace configuration, all other parts of the door mount of the present invention exist as described above. The long aspect of the single vertical piece 6 sits flat screwed vertically behind intermediary rectangular block 8 shown with a perspective of its scope and thickness (i.e. $\frac{3}{4}_{th}$"). The U-shaped yoke 9 is sketched and protrudes horizontally away and to the right of the intermediary block 8. Each are shown attached to each other as well as attached to the distal end of the long vertical piece 6. The distal end of the long aspect of the vertical piece 6 contains two holes wherein screws are used to connect piece 6 to intermediary block 8 via screw hole 16 at the far distal end and screw hole 15 at the near distal end which sits higher and closer to the top of piece 6 when it hangs vertically from the top of a standard door. All pieces (18, 19 and 6) are fused to each other at 90 degree angles. The U-shaped yoke 9 is encapsulated partially at its distal ends with soft capsules 7. The U-shaped yoke 9 grasps the guitar 27 at the point where its neck 29 meets its head 30.

Nevertheless, the user, with common knowledge of such natural functionalities of swinging doors may be wise to place the mount over the standard door in a direction where the stringed-instrument is not adjacent to a wall fixture. Also a user of reasonable awareness and sensibility will place the mount of the present invention on a standard door which is less likely to be hastily opened and/or closed with unnecessary power and/or recklessness. Nevertheless, it is an intended embodiment of the present invention that one or more two inch round foam stoppers/stickers/door protectors be available to be stuck on the standard door at a position where the free guitar body end 27 hanging vertically toward the floor would touch the standard door should the standard door be swung open or closed in such a manner which creates enough momentum for the base of the guitar 27 make contact with the surface of the standard door 28.

Hence, the embodiments disclosed herein provide a convenient and compact musical instrument swinging standard door mount that can be used with exceptional versatility, portability and safety (both for the stringed-instrument and for the fixture from which it hangs). The device is lightweight and compact and provides padded surfaces that do not mar or scratch the musical instrument.

Standard door fixtures where bolts, screws or nails are driven into the standard door are permanent alterations to the standard door. Moreover these fixtures tend to rust, deteriorate or atrophy over time due to the normal wear and tear of the atmosphere and of hanging up and removing of a stringed instrument which can weigh in excess of 15 lbs. The present invention utilizes the bulk of a standard door to counterbalance, support and provide leverage for the mounting mechanism from which the stringed-instrument hangs. This alternate use of support (done minus the need for crews, bolts or nails needing to be driven into the standard door) minimizes, among other things, wear and tear, which in turn improves longevity of the device without any complimentary and ever increasing damage to the fixture. In other words, any nails, bolts and/or screws driven into a standard door fixture mount will, over time, move and slowly gouge larger cavities inside the standard door thus causing ever increasing damage. The present invention is incapable of such wear and tear simply because as a point in fact there is no bolt, screw or nail which must gouge itself into the standard door present in this invention.

An optional incorporation of the present invention which relates to its unique ability to hang a large stringed-instrument safely securely and with minimal damage to a fixture is the use of foam stickers on the underbelly of the mount. In other words, standard foam stickers used in the art may be placed on the underside of fused pieces 18, 19 and 6 at the surface where the mount makes contact with the standard door 28. Such cushioned stickers have the effect of minimizing friction and abrasion and any other point of contact damage that would otherwise arise naturally from two hard surfaces meeting and slowly rubbing upon each other over time.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A method of hanging a guitar on a standard door comprising: (a) providing a bridge shaped supporting member that at a proximal end has a short vertical piece of predetermined length contiguous with a horizontal piece of predetermined length and at a distal end has a long vertical piece of predetermined length contiguous with the horizontal piece and placing the supporting member over the top of the door such that the short vertical piece is on one side of the door, the horizontal piece is on the top of the door and the long vertical piece is on the other side of the door; (b) providing attachment means at a plurality of locations on the long vertical piece to connect the long vertical piece to a U-shape yoke sized to receive a guitar neck between legs of the U-shaped yoke and suspending the guitar at its neck on the U-shaped yoke at a selected location; and; (c) providing an angular brace with three planes aligned with each other at predetermined angles located between the U-shape yoke and rectangular box so that the underside of the guitar neck is supported; whereby the guitar is suspended in a stable manner on the door.

2. A mount for hanging a guitar over a standard door comprising:

(a) a bridge shaped supporting member that at a proximal end has a short vertical piece of predetermined length contiguous with a horizontal piece of predetermined length and at a distal end has a long vertical piece of predetermined length contiguous with the horizontal piece;

(b) attachment means to connect the long vertical piece to a U-shape yoke sized to receive a guitar neck between legs of the U-shaped yoke; whereby a guitar can be suspended by said guitar's neck on the side of the door where the long piece is located; wherein the attachment means is a rectangular box that is screw fastened on one side to the long vertical piece and on the other side is mechanically secured to the U-shaped yoke.

3. The mount of claim 2 wherein the bridge shaped supporting member is made of steel or other rigid materials.

4. The mount of claim 2 wherein the legs of the U-shaped are covered by memory foam.

5. The mount of claim 2 wherein the long vertical piece is placed on one side of the door.

6. The mount of claim 5 wherein the short vertical piece is placed on the other side of the door.

7. The mount of claim 2 wherein the horizontal piece is placed on top of the door.

8. The mount of claim 2 wherein the attachment means can be placed at a plurality of locations on the long vertical piece; whereby said guitar may be hung at different locations on the door.

9. A mount for hanging a guitar over a standard door comprising:

(a) a bridge shaped supporting member that at a proximal end has a short vertical piece of predetermined length contiguous with a horizontal piece of predetermined length and at a distal end has a long vertical piece of predetermined length contiguous with the horizontal piece;

(b) attachment means to connect the long vertical piece to a U-shape yoke sized to receive a guitar neck between legs of the U-shaped yoke, wherein the attachment means is a rectangular box that is screw fastened on one side to the long vertical piece and on the other side is mechanically secured to the U-shaped yoke;

(c) an angular brace with three planes aligned with each other at predetermined angles; wherein the angular brace is attached in a position between the rectangular box and the U-shaped yoke, with one plane attached to said attachment means and to said U-shaped yoke; whereby a guitar and the guitar neck does not contact the door surface during normal operation of opening and closing the door.

10. The mount of claim 9 wherein the bridge shaped supporting member is made of steel or other rigid materials.

11. The mount of claim 9 wherein the legs of the U-shaped are covered by memory foam.

12. The mount of claim 9 wherein the long vertical piece is positioned on one side of the door.

13. The mount of claim 12 wherein the short vertical piece is placed on the other side of the door.

14. The mount of claim 9 wherein the attachment means can be placed at a plurality of locations on the long vertical piece; whereby said guitar may be hung at different locations on the door.

* * * * *